United States Patent [19]

Bellinger, Jr. et al.

[11] 4,136,978

[45] Jan. 30, 1979

[54] HIGH SPEED ELECTROMAGNETIC PRINTING HEAD

[75] Inventors: James E. Bellinger, Jr., Melbourne; John H. MacNeill, Indialantic, both of Fla.

[73] Assignee: Optical Business Machines, Inc., Melbourne, Fla.

[21] Appl. No.: 850,848

[22] Filed: Nov. 11, 1977

Related U.S. Application Data

[63] Continuation of Ser. No. 621,526, Oct. 10, 1975, abandoned.

[51] Int. Cl.[2] ..... B41J 3/12

[52] U.S. Cl. ..... 400/124; 101/93.05; 335/279

[58] Field of Search ..... 400/124; 101/93.04, 101/93.05, 93.28, 93.29, 93.32–93.34, 93.42, 93.48, 109, 110; 335/55, 80, 95, 124, 203, 249, 261, 279; 52/731

[56] References Cited

U.S. PATENT DOCUMENTS

| | | | |
|---|---|---|---|
| 1,234,440 | 7/1917 | Bliss | 335/95 X |
| 3,279,362 | 10/1966 | Helms | 101/109 X |
| 3,420,032 | 1/1969 | Felt | 52/731 |
| 3,672,482 | 6/1972 | Brumbaugh et al. | 400/124 |
| 3,726,213 | 4/1973 | Hebert | 101/93.33 |
| 3,745,495 | 7/1973 | Chai et al. | 101/93.29 X |
| 3,842,955 | 10/1974 | Iwasaki | 400/124 |
| 3,889,793 | 6/1975 | Cattaneo | 400/124 |
| 3,929,214 | 12/1975 | Hebert | 400/124 |

*Primary Examiner*—Paul T. Sewell
*Attorney, Agent, or Firm*—Rose & Edell

[57] ABSTRACT

A high speed printing head comprises a circular array of stylii drivers for printing characters in a dot matrix format. Each driver includes a permanent magnet and bucking coil electromagnet which when energized causes a stylus to impact a printing surface. The stylus is carried on the end of an arm supported by crossed horizontal and vertical supporting flexures at its other end whereby the arm pivots about a virtual axis lying near the plane of the working air gap of the electromagnet to reduce wear of the pole piece and armature and increase impact rebound of the arm. The magnetic structure and arm structure intersect only above the pole piece reducing flux leakage and size and weight of the structure. The arm and flexure structures are non-magnetic except at said region of intersection to reduce, in conjunction with the single region of intersection of said structures, cross-talk between adjacent drivers.

18 Claims, 8 Drawing Figures

HIGH SPEED ELECTROMAGNETIC PRINTING HEAD

This is a continuation of application Ser. No. 621,526, filed Oct. 10, 1975, now abandoned.

BACKGROUND OF INVENTION

The present invention relates to a dot matrix printing head and more particularly to a printing head comprising a generally circular array of bucking-coil, stylus drivers capable of printing 1000 characters per second or more.

The use of bucking coil stylus drivers in printing heads is known in the art; such an arrangement being currently employed in the Printronix 300 dot matrix printer and having been previously employed in character printers.

Problems with the prior art bucking coil printers arise when it is desired to greatly increase the cyclic rate of operation of the drivers beyond that which such devices currently provide. For instance, the permanent magnets employed in the prior art devices do not produce sufficient flux density to permit operation at the speeds contemplated by the present invention and when magnets of sufficient strength are employed the weight is increased and the leakage flux becomes so great that proper operation may not be achieved.

Further, an increase in the strength of the permanent magnet dictates a large increase in the strength of the bucking coil resulting in severe problems of heat dissipation and cross-talk between adjacent drivers. In addition, the overall physical structures of the prior art devices are such as to cause, at high speeds of operation, severe inertia problems and twisting, flexing and whipping of various elements; all of which at the least greatly increase the energy required to operate the system and at the worst prevent such operation or severely reduce the life of the apparatus.

SUMMARY OF THE INVENTION

In accordance with the present invention, a printing stylus of each driver stage is secured to one end of and perpendicular to a rigid light-weight arm extending generally radially of a generally circular array of such stages. The arm is supported at its other end by crossed horizontal and vertical flexures providing a virtual pivotal axis lying virtually in a particular plane to be described.

Each printer stage has a separate magnetic circuit including a permanent and an electromagnet lying in a plane that intersects the arm at a location between the ends of the arm adjacent the flexure support. At this location the arm has a soft iron insert which lies above the pole of the electromagnet and serves as the armature thereof.

The virtual pivotal axis provided by the flexures is located as close as possible to the plane of the face of the pole of the electromagnet. The flexures are prestressed so as to urge the arm away from the pole of the electromagnet, i.e., in a direction towards the platten of the printer with which the printer head is to be associated.

As a result of the high speed operation of the apparatus of the present invention, the forces generated are quite large so that the face of the pole of the electromagnet is rapidly eroded if movement of any consequence of the armature across the face of the pole is permitted. By locating the virtual pivoted axis of the arm as close to the plane of the pole face as practicable, a few thousandths removed, long life of the pole is provided. Inherently such a construction insures substantially pure impact loading between the armature and the pole so as to minimize the wiping action and maximize rebound of the arm thereby to provide energy for the next print cycle; a desirable feature at high speed operation.

In order to take advantage of the high speed operation of the print head of the present invention in a printer wherein the print head moves along a path parallel to the surface of the platten of the printer, the weight of the print head must be kept quite low so that it may be moved rapidly without requireing uneconomically large inputs of power to transport the head. A large part of the weight of the print head resides in the magnetic structure. In order to maintain the weight of the print head within reasonable limits, maximum utilization must be made of the flux available from the permanent magnet. This result is accomplished according to the present invention by having substantially all of the parts of the magnetic circuit of different polarities lie at right angles to one another so that they diverge rapidly with correspondingly rapid increase in reluctance of the leakage path. In addition, each pole of the permanent magnet is effectively isolated from the magnetic path of opposite polarity immediately adjacent the permanent magnet by means to be described subsequently.

Not only do the above features permit the print head to be of relatively light weight, they contribute greatly to the ability to construct a device operating at the desired printing speeds. The permanent magnet at best must be quite powerful to capture the armature after a print cycle. If leakage flux were not minimized, it is highly likely that sufficient flux could not be concentrated in the air gap between the armature and the pole of the electromagnet regardless of the size of the permanent magnet, within practical limits of course, to accomplish recapture.

As a result of the necessity of providing a large concentration of flux across the air gap to recapture the armature, the electromagnet required to buck this flux requires large currents and cross-talk between drivers of the print head becomes a serious problem. In accordance with the present invention, crosstalk is maintained at manageable levels by use of the aforesaid construction wherein the magnetic circuit is offset from the arm structure and the two intersect only above the pole of the electromagnet. As will become apparent upon consideration of the detailed description of the invention, such an arrangement insures that where the magnetic circuits of adjacent drivers approach one another most closely in a first plane, they are offset in the plane perpendicular to the first plane. The physical isolation provided is sufficient to maintain cross-talk at acceptable levels.

An important feature of the present invention is the ability to deliver to the printing surface a quite large proportion of the energy imparted to the arm upon its release from the pole of the electromagnet. This ability results from several factors such as: the compactness of the structure permits the use of stylii of less than Euler's critical length so that the stylii won't buckle; the use of a vertical flexure to prevent impact of the stylus from driving down the end of the arm remote from the stylus and the utilization of a hollow beam formed of two hollow C-shaped members whereby bending of the beam is minimized. The first feature above insures that little of the energy imparted to the arm-stylus structure is lost in buckling of the stylus while the latter two features insure that little of the energy imparted to the stylus is lost in bending of the arm or in driving down the end of the arm remote from the stylus.

The use of crossed horizontal and vertical flexures greatly reduces lateral and rotational motion of the beam and the length of time of contact between the stylus and printing surface relative to such factors when using a single leaf spring.

It is an object of the present invention to provide a high-speed, bucking-coil, dot-matrix printer.

It is another object of the present invention to provide crossed generally horizontal and vertical flexures to support stylus carrying arms of a printing mechanism.

It is yet another object of the present invention to provide a stylus driver for a dot-matrix printer wherein the stylus is carried on an arm which, in the non-profit position, is retained against the pole of a bucking coil electromagnet forming one element of a magnetic path including a permanent magnet and wherein the magnetic path intersects the beam only at the pole of the electromagnet.

Another object of the present invention is to provide a dot-matrix print head having a plurality of stylii drivers arranged generally concentric to the center of the print head, each driver including a stylus supporting arm lying generally along a radius of the concentric arrangement of drivers and a magnetic circuit disposed in a plane intersecting the supporting arm between its ends and adjacent the end of the arm remote from the stylus.

Yet another object of the present invention is to provide a magnetic path for a high speed dot-matrix printer which path includes a permanent magnet and a bucking coil electromagnet wherein leakage flux is minimized by causing relatively long parallel members of the magnetic path to be at the same magnetic polarity and having members of different magnetic polarities lying at large angles relative to one another.

BRIEF DESCRIPTION OF THE DRAWINGS

The above and still further objects, features and advantages of the present invention will become apparent upon consideration of the following detailed description of several specific embodiments thereof, especially when taken in conjunction with the accompanying drawings, wherein.

DETAILED DESCRIPTION OF THE INVENTION

The terms "vertical," "horizontal," "top plate," "bottom plate" and similar expressions are used herein only for the purpose of facilitating description and are not intended to be limiting. In fact, the position of the print head on its carriage is such that vertical members become horizontal members and top and bottom plates become side plates. Further, although throughout the specification the flexures are stated to lie in the horizontal and vertical planes there are two aspects of this arrangement that must be considered. First, crossed flexures lying substantially at right angles to each other, regardless of the plane in which they lie, will provide some of the features claimed for the specific arrangement described herein. In this context reference is made to copending United States patent application Ser. No. 529,544 filed on Dec. 4, 1974, in the names of the inventors hereof. The use of horizontal and vertical flexures is preferable in the present invention due to space considerations and due to reduction of wear of the pole piece resulting from use of the horizontal flexure. Second, deviations from exact horizontal and vertical alignment and 90° alignment of the flexures relative to one another are also permissible with consequent reduction in some of the advantages obtained with precise alignment in these planes, such reduction being generally a function of the degree of such deviations.

Figure 1:
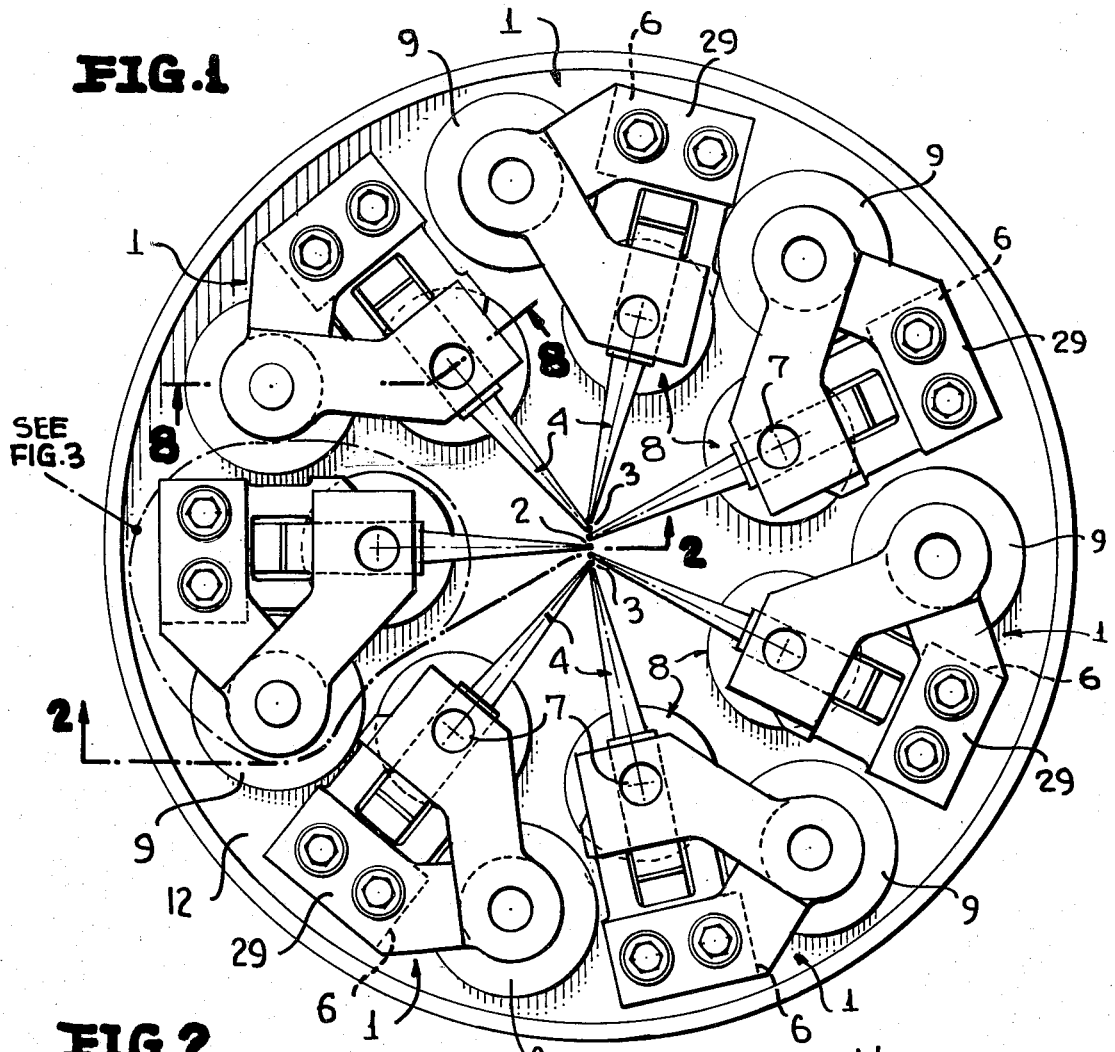
FIG. 1 is a top plan diagramatic view of the print head of the present invention.
Figure 2:
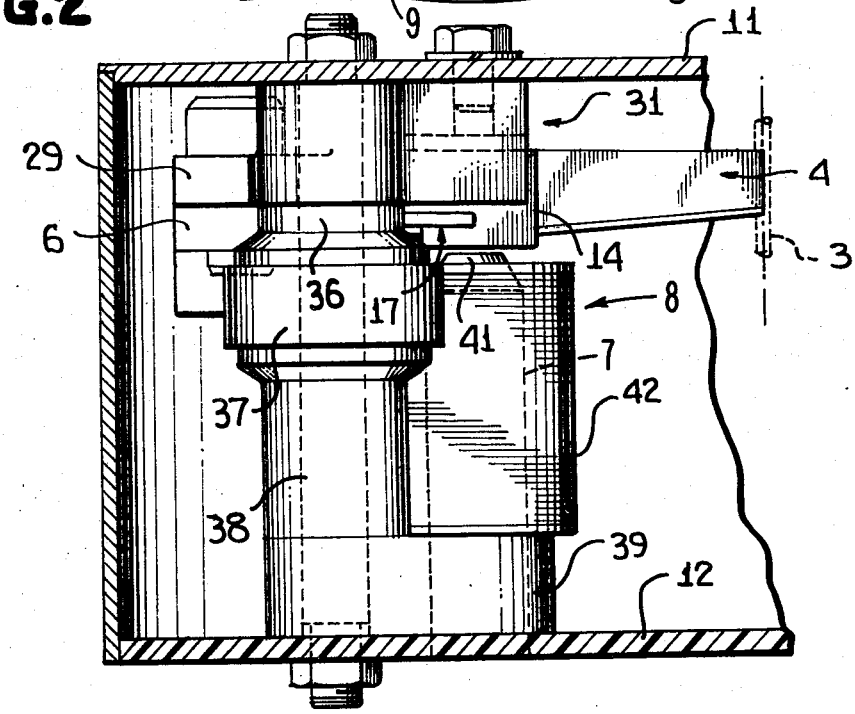
FIG. 2 is a vertical view in cross-section taken along line 2—2 of FIG. 1.

Referring now specifically to FIG. 1 of the accompanying drawings there is illustrated a top plan view with a top plate removed of a print head constructed in accordance with the principles of the present invention. The head is indicated as providing seven stylus drivers 1 capable of printing a 7 × 5 or 7 × 7 font. Fonts of 8 × 7 and 9 × 7 for printing upper and lower case characters may also be employed. The 7 × 7 font was utilized in printing at 1000 characters per second and in accordance with this font all vertical positions can are are printed whenever required whereas in the horizontal dimension of the characters two adjacent dots are not printed by a given stylus; that is, no more than every other dot position is printed by a given stylus in any character configuration. As a result each stylus must be capable of operating at 4500 Hz to provide printing at 1000 characters per second.

The head illustrated in FIG. 1 is carried by a printing mechanism carriage (not illustrated) to produce a line of up to at least 132 characters, for example.

Referring again specifically to FIG. 1 the stylus drivers 1 are arranged generally circularly about a center point of the apparatus generally designated by the reference numeral 2. True concentricity is not obtained since the stylii must be arranged basically in line so that a slight offset of the drivers in the vertical position, as illustrated in FIG. 1, is required to minimize stylus offset.

The stylii which are generally designated by the reference numeral 3 are carried on one end of generally radially arrayed arms 4 pivoted at a support block 6 lying adjacent the outer periphery of the apparatus. Each arm 4 passes over the center of a pole piece 7 of an electromagnet generally designated by the reference numeral 8 and is retained, during intervals when the electromagnet 8 is not energized, against the pole piece 7 due to flux produced by a permanent magnet 9.

The pivot structure for the arm 4 is, as will be described more fully subsequently, a spring biased arrangement which urges the arm 4 away from pole piece 7 of the electromagnet 8 and towards a printing surface. When the electromagnet is energized the flux produced by the permanent magnet 9 is neutralized and the stylus is urged, by means of the spring arrangement referred to above, out of the plane of the page towards the reader. When the electromagnet 8 is de-energized the arm 4 is recaptured by means of the flux produced by the permanent magnet 9 and pulled back against the face of the pole 7.

Referring now specifically to FIGS. 2 through 7 the apparatus is provided with top and bottom plates 11 and 12 respectively between which all elements of the apparatus are mounted. The arm 4 is comprised of a beam 13 and a block of magnetic material which constitutes armature 14 of the electromagnet 8. The armature 14 is centered on the pole piece 7 of the electromagnet and is supported by a flexure (spring) structure as fully shown in FIGS. 2, 3, 4 and 6.

Figure 4:
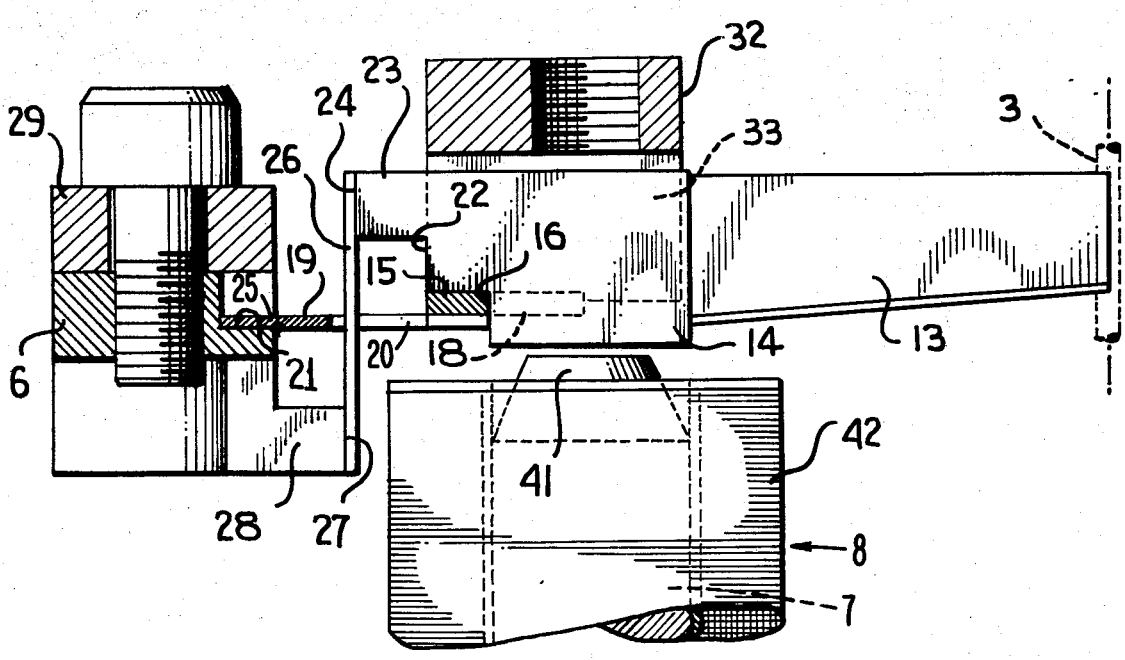
FIG. 4 is a vertical view in cross-section taken along line 4—4 of FIG 3.
Figure 6:
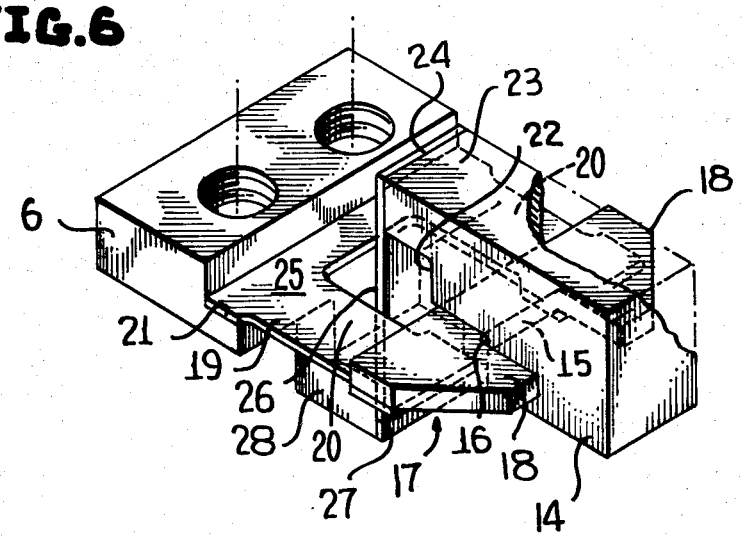
FIG. 6 is a view in perspective of the arm, the flexure structure and the flexure support.

The bottom surface, as viewed in FIGS. 4 and 6, of the armature 14 has a step 16 formed therein for receiving cross-member 15 of a bifurcated horizontal flexure support 17. Legs 18 of the bifurcated member 17 extend from the cross-member 15 along the opposite sides of and in contact with the armature 14. The bifurcated member 17 is secured to the armature 14 by suitable means such as brazing, silver-soldering, etc. A bifurcated horizontal flexure 19 has its legs 20 secured to the underside of the cross-member 15 of the bifurcated member 17 by suitable means and has its base 25 secured to a ledge or slot 21 of the support block 6.

Figure 3:
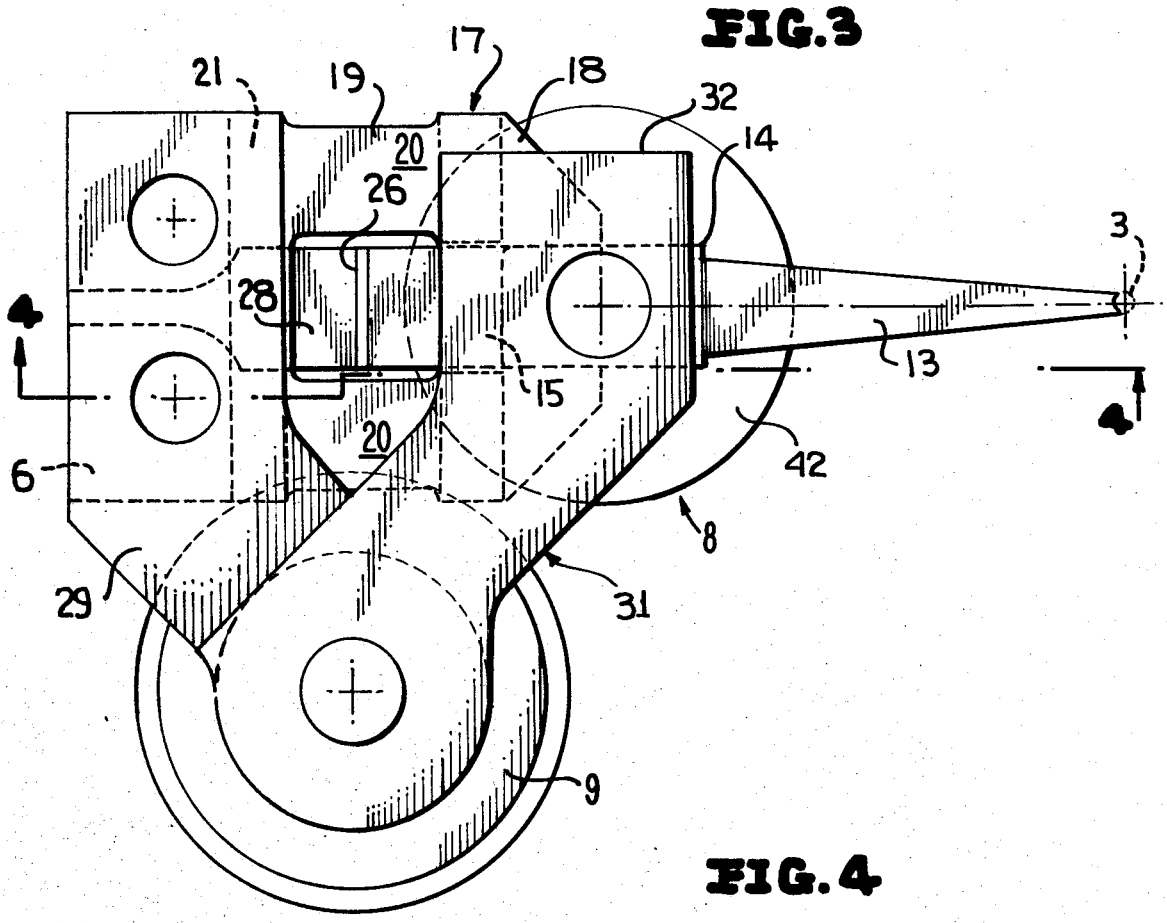
FIG. 3 is an enlarged detailed top view of the region enclosed within the dot-dash line in FIG. 1.

The armature 14 has a further step 22 formed therein to provide a narrow leftward extension 23 as viewed in FIGS. 3, 4 and 6 to define a narrow vertical surface 24 to which is secured a vertical flexure 26. Vertical flexure 26 passes downwardly between the legs 20 of the bifurcated horizontal flexure 19. The vertical flexure 26 is secured to a vertical surface 27 of a rightwardly extending projection 28, viewed in FIG. 6, of the support block 6.

Figure 5:
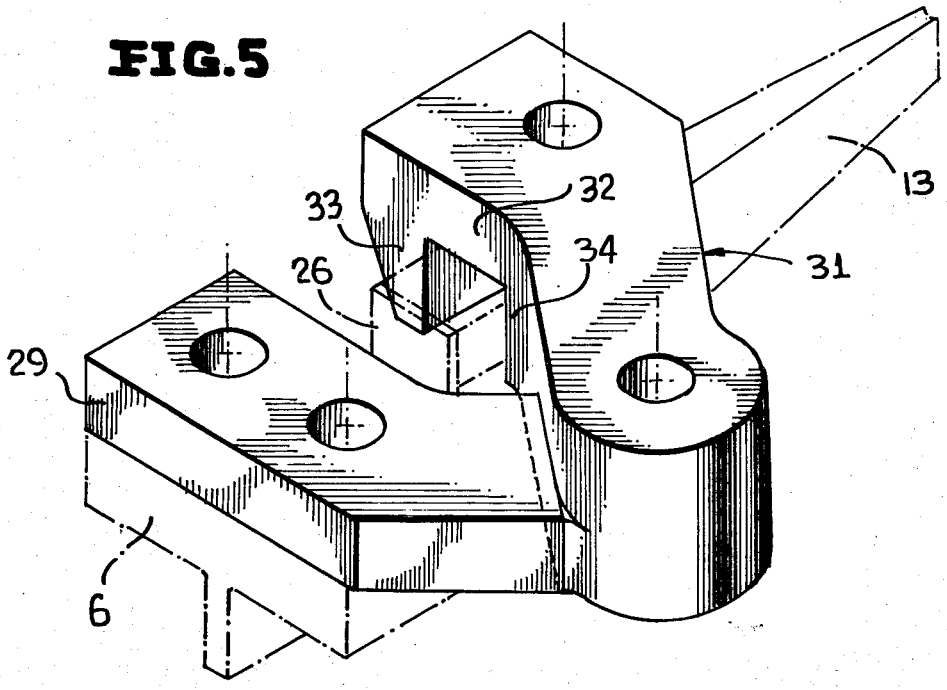
FIG. 5 is a view in perspective of the structure of the upper part of the magnetic path and flexure-anchor support plate.

The support block 6 is secured to the underside, as viewed in FIG. 5, of a plate 29 suitably secured to a surface of a cheek piece 31; the latter constituting the upper cross member of the magnetic circuit of the apparatus.

The cheek piece 31 is slotted to provide a horizontal cross-member 32 and two legs 33 and 34 arranged along opposite sides and in close proximity to the armature 14; this part of the cheek piece 31 serving to transfer flux from the magnet circuit to the armature. The legs 33 and 34 are centered on the center line of the armature 14 and therefore of the arm 4.

Figure 8:
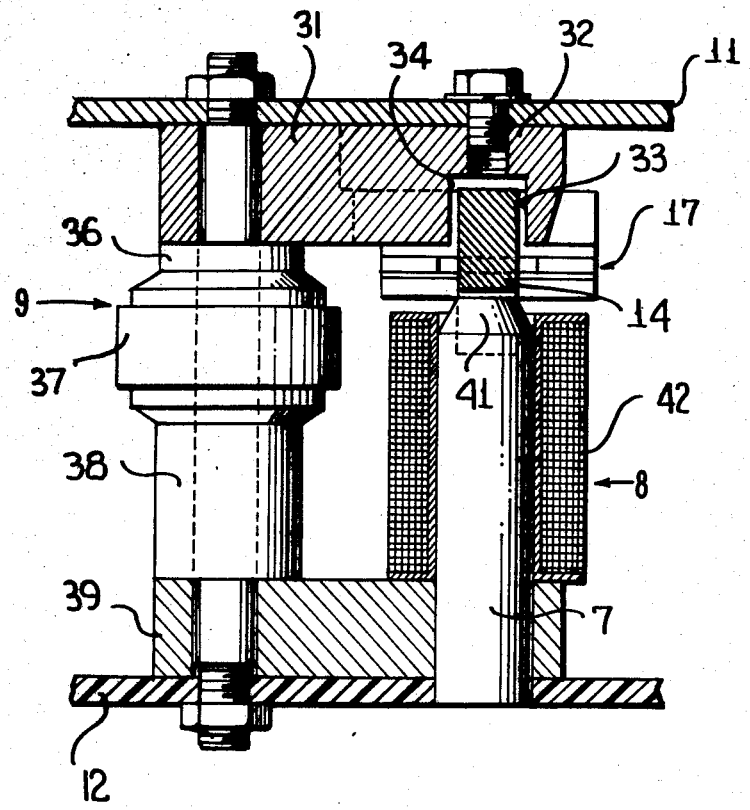
FIG. 8 is a view in cross-section of the structure of the magnetic circuit taken along line 8—8 of FIG. 1.

Reference is now made to FIG. 8 of the accompanying drawings. The magnet circuit or path of the apparatus of the present invention comprises the cheek piece 31, a cylindrical spacer 36 of magnetic material, cylindrical permanent magnet 9, a relatively long cylindrical leg 38; the members 36, 37 and 38 being arranged in series downwardly as viewed in FIG. 8. The circuit is completed by a cross-member 39 of magnetic material perpendicular to the leg 38 and the cylindrical pole 7 of the electromagnet 8; the pole 7 extending into, secured to and perpendicular to the cross-member 39. Pole tip 41 is tapered; so as to have a width slightly less than the width of the armature 14 as indicated in FIG. 3 of the accompanying drawings. A coil 42 is disposed about the pole 7 and suitably held in position relative thereto.

The members 7, 31, 36, 37, 38 and 39 constitute a four-sided magnetic structure having a single gap lying between pole 7 and cheek piece 31. Specifically the magnetic structure provides a continuous path of magnetic material having a single interruption therein. The armature 14 lies in the aforesaid gap and completes the magnetic structure.

Referring now to the specific details of the various parts of the apparatus, it will be noted that when the electromagnet is not energized the only flux induced in the magnetic circuit or structure is that produced by the permanent magnet 9. The armature 14 is attracted to the pole tip 41 and the only air gap in the circuit lies between the armature 14 and the crossmember 32 and legs 33 and 34 of the cheek piece 31. The permanent magnet 9 must be quite powerful and it is preferable to utilize, in the structure illustrated, a sumarian-cobalt magnet. Alnico 8 or 9 may be utilized if extended substantially from the cheek piece 31 to the cross-member 39.

The size of the coil 42 required to overcome the flux at the closed gap between the armature 14 and tapered pole tip 41 requires that relatively long, parallel, magnetic paths exist between the members 7 and 38 of the magnetic circuit to accomodate the coil 42. Leakage flux between the members 7 and 38 is minimized by locating the permanent magnet 9 relatively close to the cheek piece 31 so that the members 7 and 38 are at the same magnetic polarity and leakage does not occur therebetween.

In addition, it will be noted that the members 36 and 38 where they approach the permanent magnet 9 are flaired outwardly but are not as large in diameter as the permanent magnet 9. The flaired portion of the members 36 and 38 are such that they provide a low reluctance path for the flux from the magnet 9 and are large enough that these members are not magnetically saturated. In consequence the flux from each of the poles is readily directed to its adjacent member and leakage of flux around the edge of the magnet is minimized. Further, it will be noted that the lower edge of the permanent magnet is spaced, by the means of the member 36, from the cheek piece 31 again to minimize leakage from the lower surface of the magnet 37 to the cheek piece. The member 36 and pole 7 are at different polarities; however, the large cross-sectional area of the cheek piece 31 causes a substantial portion of the flux in that region to be directed into the cheek piece and not to leak across the air path to the pole 7. The flux emanating from the lower edge of the permanent magnet 9 is of a different polarity from that in the cheek piece but due to the flaired portion of the member 38, leakage of flux to the cheek piece 31 is maintained at acceptable levels. Also cheek piece 31 and members 7 and 38 are at right angles rather than parallel so that average magnetic reluctance between these elements is large. Thus, there is established a magnetic circuit having an acceptably low leakage; an essential feature of the apparatus of the present invention.

It will be noted that the cheek piece 31 and the members 36, 37, 38 and 39 are drilled along a common axis so that a bolt or stud may be passed therethrough and secured at either end by nuts to provide for assembly of the apparatus between the end plates 11 and 12.

Referring now specifically to the cross flexure arrangement and reference is made primarily to FIGS. 4 and 6 of the accompanying drawings, the flexures 19 and 26 are prestressed so as to spring bias the arm 4 away from the pole tip 41 of pole 7. Thus when the electromagnet 8 is energized, the armature 14 is moved rapidly away from the pole, in an upward direction as illustrated in the Figures, and towards a working or printing surface. It will be noted that stylus 3 is carried on the end of the arm 4 remote from the flexure structure and is directed upwardly as illustrated in FIG. 4. Since the stylii move upwardly to print, and since the greatest dimension of the apparatus in the vertical plane lies under the arm 4, the printing head may be spaced quite close to the printing surface and the stylii 3 may be quite short. As a further result the stylii may be maintained at a length less than Euler's critical length and the tendency to buckle upon impact as the printing surface is minimized. In the apparatus illustrated the force delivered by the stylus is sufficient to produce printing on an original and five carbon copies of a standard computer printout paper.

In view of the large force required to be delivered at the printing surface, the tendency of the arm 4 to twist or bend or of the flexures to yield must be minimized to insure that substantially all available energy is directed to printing. The use of crossed flexures and particularly a substantially vertical flexure 26 is critical to this latter feature. The vertical flexure being a relatively stiff member, resists the tendency of the left end of the arm 4, as viewed in FIG. 4, to move downwardly upon impact of the stylus on the printing surface. The crossed flexures and particularly the vertical flexure, resist the tendency of the arm 4 to rotate about its longitudinal axis and bending of the arm is resisted by the preferred structure of the beam 13 as illustrated in FIG. 7 of the accompanying drawings.

Figure 7:
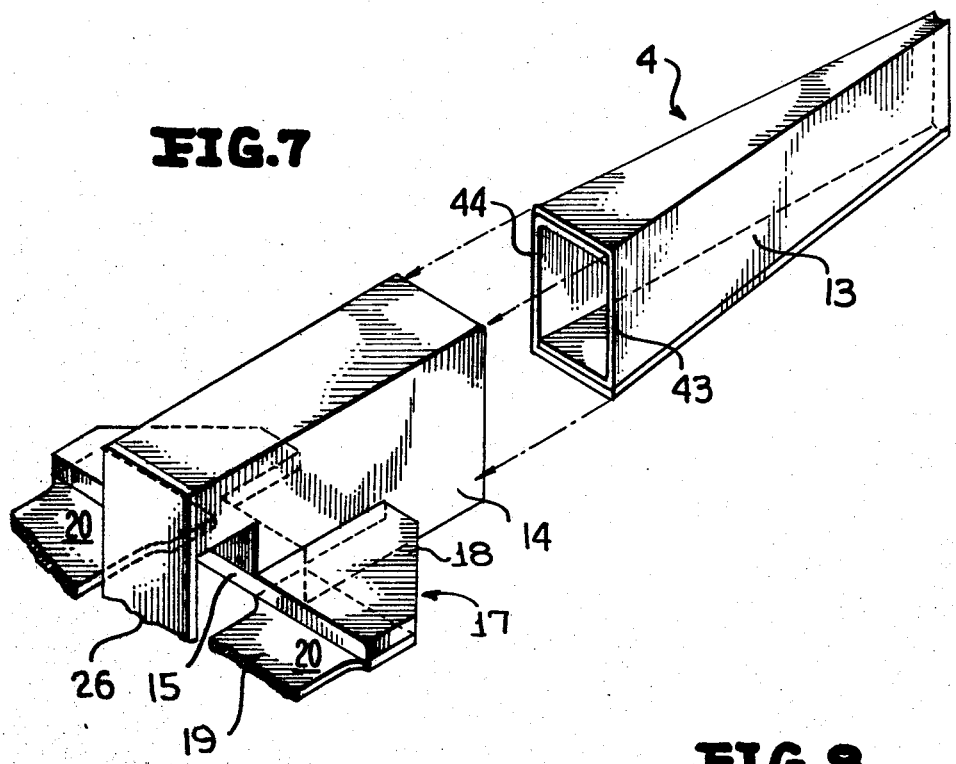
FIG. 7 is a view in perspective of the beam part of the stylus support arm.

Referring specifically to FIG. 7, the beam 13 is preferably, though not necessarily fabricated from two C-shaped members 43 and 44. The C-shaped members are squared-C's of identical size and are tapered inwardly along the sides and upwardly from the bottom surface proceeding from the armature 14. The horizontal legs of the C-shaped members are overlapped and brazed so as to provide additional thickness at the top and bottom surfaces thereby to resist bending of the beam 13 in the vertical plane and further to resist twisting of the beam. The side surfaces are of single thickness since they are not subject to the same bending forces as the upper and lower surfaces of the beam.

The flexure arrangement, particularly the location of the horizontal flexure 19, is critical and the center line of the horizontal flexure 19 should lie as close to the face of the pole tip 41 as is possible. The thickness of the flexure, of course, prevents the center line of the horizontal flexure from lying in the plane of the face of the pole tip. The bottom surface of the flexure, and reference is made to FIG. 4, may lie at the unnotched bottom surface of the armature 14 or may be slightly recessed into the notch as illustrated. The displacement of the center line of the flexure 19 should be as small as possible so that when the armature 14 impacts against the end of the pole tip 41 as little translatory movement as possible is encountered. The wiping motion produced by translatory movement when operating at the speeds contemplated herein quickly erodes the end surface of the pole tip 41 and must be minimized. A pole tip with a tapered end can be utilized only if such structure is utilized; the tapering of the pole tip being quite important to proper concentration of the flux in the gap between the pole piece and the armature when the armature has been released and it is desired to recapture it. The large concentration of the flux at this region in conjunction with the rebound of the stylus and arm after impact at the printing surface is essential to rapid recovery of the armature by the pole 7. If the pole tip could not be tapered or if flexing and twisting of the beam and buckling of the stylus 3 were not minimized, the high speed of operation of the present apparatus could not be accomplished.

Referring now specifically to FIGS. 1 and 4 a further feature of the present invention resides in the fact that the arm structure and the magnetic structure intersect only in the region of the armature 14. This is a particularly important aspect of the present invention since in such tightly packed spaces where relatively high currents must be supplied to the coil in order to obtain the necessary nulling of a large flux concentration in the interface between the pole 7 and the armature 14, cross-talk between magnetic circuits of adjacent drivers becomes a serious problem. By locating the magnetic structure at an angle to the structure of the arm and by making all of the parts of the mechanism, other than the specific magnetic circuit, out of the nonmagnetic materials, cross-talk and leakage are reduced to an acceptable level. The location of the magnetic circuit off to one side of the axis of the arm 4, causes magnetic circuits of adjacent drivers to approach one another, and reference is made to FIG. 1, only in a region adjacent an edge of the cheek piece 31 and the permanent magnet 9. As can be seen from FIGS. 4 and 8, the cheek piece 31 of one driver and the permanent magnet 9 of an adjacent driver are vertically displaced; the displacement being sufficient to reduce cross talk to an acceptable level, i.e., a level which has been found not to produce interference between the circuits surfficient to deteriorate performance of the circuits.

Another aspect of the specific arrangement of the magnetic circuit off to one side of the arm 4 is to reduce the overall radius of the arm 4 and of the print head and thus reduce the weight of the structure and the inertia of the arm. In order to provide a structure operating at the speeds contemplated herein, excessive bounce and inertia of the arm 4 can not be permitted and in order to insure this fact, the pivot of the arm 4 is preferably located outwardly of the point of impact between the arm 4 and the pole 7 so that the impact is near the radius of gyration of the arm. This is easily accomplished without excessive radial length in the present invention by the use of the magnetic circuit arranged as described above.

There is a specific relationship between the tapering of the pole piece and the flexures. The use of the tapered pole piece provides less variation between the open and closed air gap flux. This feature is important so that lower spring rates can be used for the flexures. The dimensions of the apparatus are not as critical with lower spring rates and the recovery time of the arm is reduced. A further feature of the cross-flexure arrangement, wherein the flexures are under high spring force before the coil releases the arm, is that maximum force is applied to the arm 4 in its captured position so as to quickly separate the arm from the pole. Soon after release of the armature, the arm acquires a velocity that remains substantially constant throughout its stroke so that a substantial force can be delivered by the stylus to the printing surface over a range of paper thickness and platten adjustment.

The features of the present invention set forth herein are of importance in obtaining a serial, dot-matrix, printer capable of operating at 1000 characters-per-second or more. Deviations from certain of these features may be permitted without reduction in speed on the one hand or quality on the other and in some instances either unless the speed is above 1000 char/sec. For instance, a hollow beam without reinforced top and bottom walls may be employed and in some instances an I-beam may be utilized. Elimination of other features may, however, reduce overall obtainable speed or life but their elimination does not alter the viability of the retained features. For instance elimination of the isolation of the magnetic and non-magnetic circuits does not reduce the utility of the horizontal and vertical flexures while elimination of the latter feature does not reduce the utility of the former.

While we have described and illustrated specific embodiments of our invention, it will be clear that variations of the details of construction which are specifically illustrated and described may be resorted to without department from the true spirit and scope of the invention as defined in the appended claims.

We claim:

1. A stylus printer mechanism comprising a plurality of stylus drivers, each of which includes:

an arm lying in a first plane and having a first end for supporting a stylus substantially perpendicular to said arm and a second end, means for pivotally supporting said second end of said arm, a body of magnetic material disposed in said arm adjacent said second end of said arm, and a magnetic structure providing a continuous magnetic path having a single gap therein and including a permanent magnet and an electromagnet having a pole piece, said gap located adjacent said pole piece, said magnetic structure lying in a second plane, said second plane lying at an angle to said first plane, said magnetic structure and said arm intersecting only in the region of said body of magnetic material, said body of magnetic material being disposed in said gap adjacent said pole piece and forming the armature of said electromagnet.

2. A stylus printer mechanism according to claim 1 wherein said magnetic structure comprises a four sided structure of magnetic material having a pair of end members and a pair of side members, and wherein said electromagnet is located in a first of said side members, said permanent magnet is disposed in said other of said side members adjacent a first of said end members, said gap being located between said first end member and said first side member, said pole piece defined by said first side member adjacent said gap.

3. A stylus printer mechanism according to claim 2 wherein a slot is formed in said first end member adjacent said pole piece, said arm extending through said slot with said magnetic material adjacent said pole piece.

4. A stylus printer mechanism according to claim 1 wherein said means for pivotally supporting said arm comprises a pivotal axis for said arm lying in a third plane, a surface of said body of magnetic material being closely adjacent and substantially parallel to said third plane, said pole piece having a generally flat surface parallel to and closely spaced relative to a said third plane.

5. A stylus printer mechanism according to claim 4 wherein said means for pivotally supporting said arm is characterized by first and second stiff, non-magnetic flexure members disposed substantially at right angles to one another and having a thin dimension, a non-magnetic, stationary support means, said first flexure member having the center of its thin dimension lying in said third plane and secured at one end to said support means and at the other end to said arm, said second flexure member extending from said arm to said support means.

6. A stylus printer mechanism according to claim 1 wherein said arm comprises;

said body of magnetic material, and a closed, hollow beam of non-magnetic material, said beam comprises a pair of channel members, each shaped as a squared-C in cross-section, said channel members secured to one another along fully overlapping top and bottom members of said channels, said top and bottom members lying in planes substantially perpendicular to the stylus.

7. A stylus printer mechanism according to claim 1 comprising a plurality of stylus drivers arranged in a common plane perpendicular to said stylii, said drivers arranged generally concentrically in said common plane, said arms disposed generally radially relative to said concentric arrangement, and each of said second planes lying at an acute angle to each associated first plane.

8. In a driver having an elongated arm having two ends, said arm supporting a working member adjacent a first of said ends, a support structure for said arm comprising a pair of stiff flexible members each having two ends, a first of said flexible members secured at one of said ends to a support member and secured at the other of said ends to a second of said ends of said arm, said first of said flexible members being disposed parallel to the longated axis of said arm, a second of said flexible members being disposed substantially at right angles to said elongated axis of said arm and to said first of said flexible members and secured at one end to a support member and at its other end to said second of said ends of said arm.

9. In a driver according to claim 8 further comprising a body of magnetic material disposed in said arm adjacent said second end of said arm, a magnetic structure having included therein a permanent magnet, an electromagnet having a pole piece and a flux gap in said magnetic structure located adjacent said pole piece, said magnetic structure defining a flux path lying at an angle to said arm and intersecting said arm only in the region of said body of magnetic material, said body of magnetic material being disposed in said gap adjacent said pole piece and forming the armature of said electromagnet.

10. A driver according to claim 8 wherein said first flexible member is arranged substantially coplanar with a surface of said arm, said arm is adapted to move in a first plane, said first flexible member lying in a plane perpendicular to said first plane.

11. A driver according to claim 9 wherein said first flexible member is arranged substantially coplanar with a surface of said body of magnetic material adjacent said pole piece.

12. In a driver according to claim 9 further comprising a body of magnetic material comprising a part of said arm and disposed adjacent said second end of said arm, and wherein said first flexible member is substantially coplanar with a surface of said body of magnetic material.

13. In a dirver according to claim 8 further comprising magnetic material disposed in said arm, a magnetic structure defining a magnetic flux path lying at an angle to said arm and intersecting said arm only in the region of said body of magnetic material, said magnetic structure including means for varying flux in said magnetic structure adjacent said body of magnetic material.

14. In a driver having a two-ended, elongated arm adapted to support a working member adjacent a first of said ends wherein said arm includes a pivot adjacent a second end of said arm permitting movement of said arm in a first plane, a closed, hollow beam comprising a pair of tapered channel members constituting mirror images of one another and shaped as a squared-C in cross-section, said channel members secured to one another along fully overlapping top and bottom members of said channels, said top and bottom members lying in planes generally perpendicular to said first plane.

15. A stylus actuating mechanism comprising at least one stylus driver, said stylus driver including:

an arm having a first end for supporting a stylus and a second end, said arm lying in a first plane, means for pivotally supporting said arm adjacent said second end for movement in and parallel to said first plane, a body of magnetic material disposed in said arm, a magnetic structure providing a continuous magnetic path having a single gap therein and including an electromagnet having a pole piece in said magnetic path, said gap located adjacent said pole piece, said magnetic structure defining a flux path lying in a second plane at an angle to said first plane, said arm passing through said gap in said magnetic structure with said magnetic material lying in said gap in alignment with said pole piece whereby said arm and said magnetic flux path intersect only at said body of magnetic material and said body of magnetic material forms the armature of said electromagnet.

16. The combination according to claim 1 wherein said magnetic structure has a slot formed therein defining at least a part of said gap and said arm passes through said slot with said magnetic material lying in said slot.

17. The combination according to claim 2 wherein there is provided an electric coil disposed about said one of said side members, and wherein said permanent magnet is disposed in said other of said side members completely below the other of said end members.

18. The combination according to claim 17 wherein there are provided a plurality of said stylus drivers, said stylus drivers arranged in a common plane perpendicular to the direction of movement of said arms, said drivers disposed generally concentrically in said plane with said arms generally radial relative to the center of said common plane, and said magnetic structures all lying to the same side of its associated arm at an acute angle thereto.

* * * * *

UNITED STATES PATENT AND TRADEMARK OFFICE

CERTIFICATE OF CORRECTION

PATENT NO. : 4,136,978

DATED : January 30, 1979

INVENTOR(S) : JAMES E. BELLINGER, JR. and JOHN H. MAC NEILL

It is certified that error appears in the above-identified patent and that said Letters Patent are hereby corrected as shown below:

Change the name of the Assignee from "Optical Business Machines, Inc."

to ---FLORIDA DATA CORPORATION ---.

Signed and Sealed this

*Eighth* Day of *May 1979*

[SEAL]

*Attest:*

RUTH C. MASON
*Attesting Officer*

DONALD W. BANNER
*Commissioner of Patents and Trademarks*